United States Patent [19]

Pinkel

[11] 4,078,704

[45] Mar. 14, 1978

[54] COAL FEED LOCK

[75] Inventor: I. Irving Pinkel, Fairview Park, Ohio

[73] Assignee: The United States of America as represented by the United States Department of Energy, Washington, D.C.

[21] Appl. No.: 752,937

[22] Filed: Dec. 21, 1976

[51] Int. Cl.[2] ..... G01F 11/24; C10J 3/30

[52] U.S. Cl. ..... 222/218; 48/86 R; 314/17 R

[58] Field of Search ..... 222/216, 217, 218; 214/17 B; 48/86 R

[56] References Cited

U.S. PATENT DOCUMENTS 4,009,788 3/1977 Waldhofer ..... 222/218 X

FOREIGN PATENT DOCUMENTS 67,437 8/1948 Denmark ..... 222/218

*Primary Examiner*—Robert B. Reeves
*Assistant Examiner*—Frederick R. Handren
*Attorney, Agent, or Firm*—Dean E. Carlson

[57] ABSTRACT

A coal feed lock is provided for dispensing coal to a high pressure gas producer with nominal loss of high pressure gas. The coal feed lock comprises a rotor member with a diametral bore therethrough. A hydraulically activated piston is slidably mounted in the bore. With the feed lock in a charging position, coal is delivered to the bore and then the rotor member is rotated to a discharging position so as to communicate with the gas producer. The piston pushes the coal into the gas producer. The rotor member is then rotated to the charging position to receive the next load of coal.

4 Claims, 3 Drawing Figures

FIG. 1
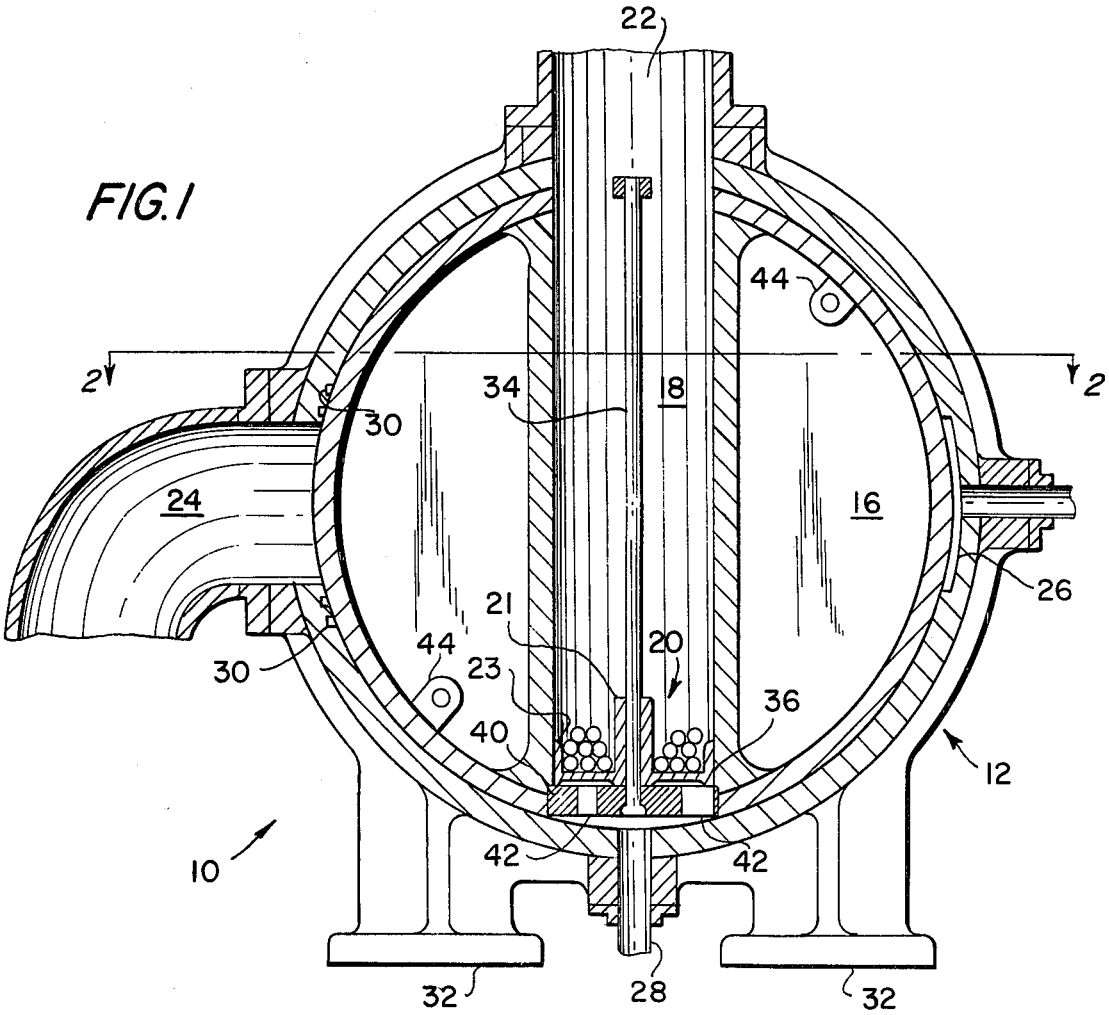
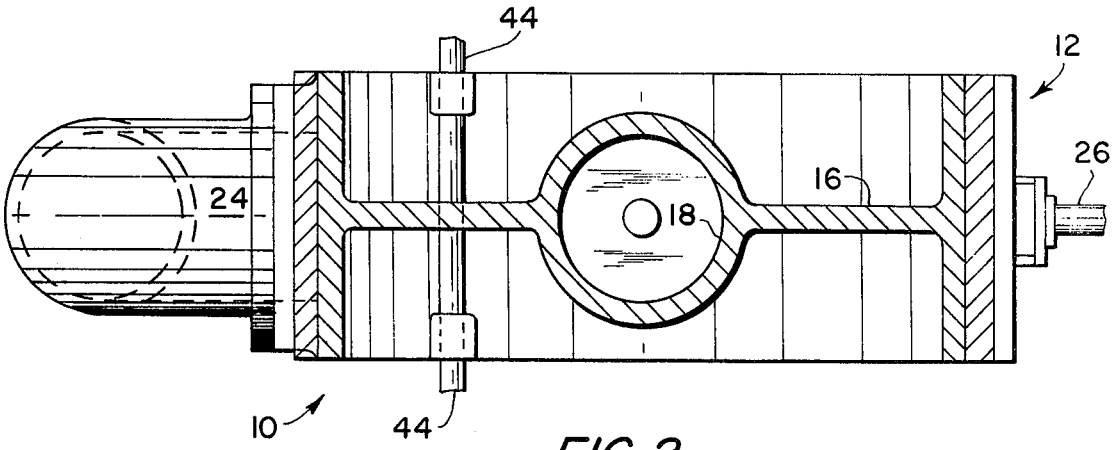
FIG. 2

COAL FEED LOCK

BACKGROUND OF THE INVENTION

1. Field of the Invention

This invention relates to coal feed locks and more particularly to apparatus for supplying coal to high pressure gas producers.

2. Description of the Prior Art

Typically, conventional coal feed locks for delivering coal to high pressure gas producers or gasifiers employ sealable transfer chambers. In operation, the coal is dropped or otherwise loaded into the transfer chamber and the chamber is then sealed from the atmosphere. The chamber is then placed in communication with the high pressure gas producer and the coal is allowed to flow into the gas producer.

Conventional coal feed locks of the type described suffer a number of important disadvantages which greatly limit their usefulness. Perhaps the most important disadvantage is that such locks permit large volumes of high pressure gas to escape to the atmosphere. The high pressure gas can escape in several ways. For example, gas may simply leak through the various seals of the lock. More importantly, each time a measured amount of coal is transferred to the gas producer, the transfer chamber fills with high pressure gas. This gas is released to the atmosphere prior to or during the refilling of the transfer chamber with coal and thus is lost.

Additionally, prior art coal locks require large amounts of head room. Further, since very high pressures are involved, the moving parts of these coal locks tend to become unbalanced, causing excessive wear and resulting in increased high pressure gas loss and increased maintenance costs.

A number of prior art devices exist that can deliver metered portions of a material from a bulk supply of the material. Examples of such prior art devices can be found in the following U.S. Pat. Nos. 2,893,609; 2,914,223; 3,172,578; 3,394,850; 3,794,234.

SUMMARY OF THE INVENTION

In accordance with a preferred embodiment of the invention, a coal feed lock for transferring coal to a high pressure gas producer is provided. The coal feed lock includes a housing having a coal charging port and a coal discharging port. Rotatably mounted within the housing is a rotor member which has a bore therethrough. The bore is rotatable from a coal charging position in coaxial alignment with the charging port to a coal discharging position in coaxial alignment with the coal discharging port. A piston element, confined by and slidable within the bore, and activated by a source of high pressure water, discharges coal through the discharge port.

According to the present invention, a coal feed lock is provided that overcomes the disadvantages associated with the prior art systems described above. The coal feed lock of the invention is provided with shallow grooving surrounding the discharge port to the coal gasifier. A source of water that is maintained at a higher pressure than the gas in the gasifier is connected to the shallow grooving. Consequently, any leaks about the discharge port will be water and not gas leaks.

The coal feed lock of the invention prevents high pressure gas from escaping after each load of coal is delivered to the gasifier. As the piston pushes the coal in the bore into the gasifier, the piston simultaneously decreases the volume of the bore exposed to the high pressure gas. Thus, little or no high pressure gas is trapped in the bore as the bore is brought out of communication with the gasifier. When the bore is realigned with the charging port, the trapped gas, if any, escapes to the atmosphere.

The coal feed lock of the invention requires less head room than conventional devices. Consequently, the gasifier and coal feed lock combination can be used where height restrictions would prevent use of conventional systems.

A further advantage of the invention is that the coal feed lock has only two moving parts. Thus, maintenance requirements due to part wear is reduced. A further fact reducing maintenance requirement is the static balance system that is provided. This static balance system uses high pressure water to counteract the forces placed on the coal feed lock by the high pressure gas.

Additional features and advantages of the invention will be set forth in, or apparent from, the detailed description of the preferred embodiments of the invention found hereinbelow.

BRIEF DESCRIPTION OF THE DRAWINGS

FIG. 1 is a cross-sectional view illustrating the loading mode of the coal feed lock in accordance with the invention;

FIG. 2 is a cross-sectional view taken generally along line 2—2 of FIG. 1.

DETAILED DESCRIPTION OF THE PREFERRED EMBODIMENTS

Figure 3:
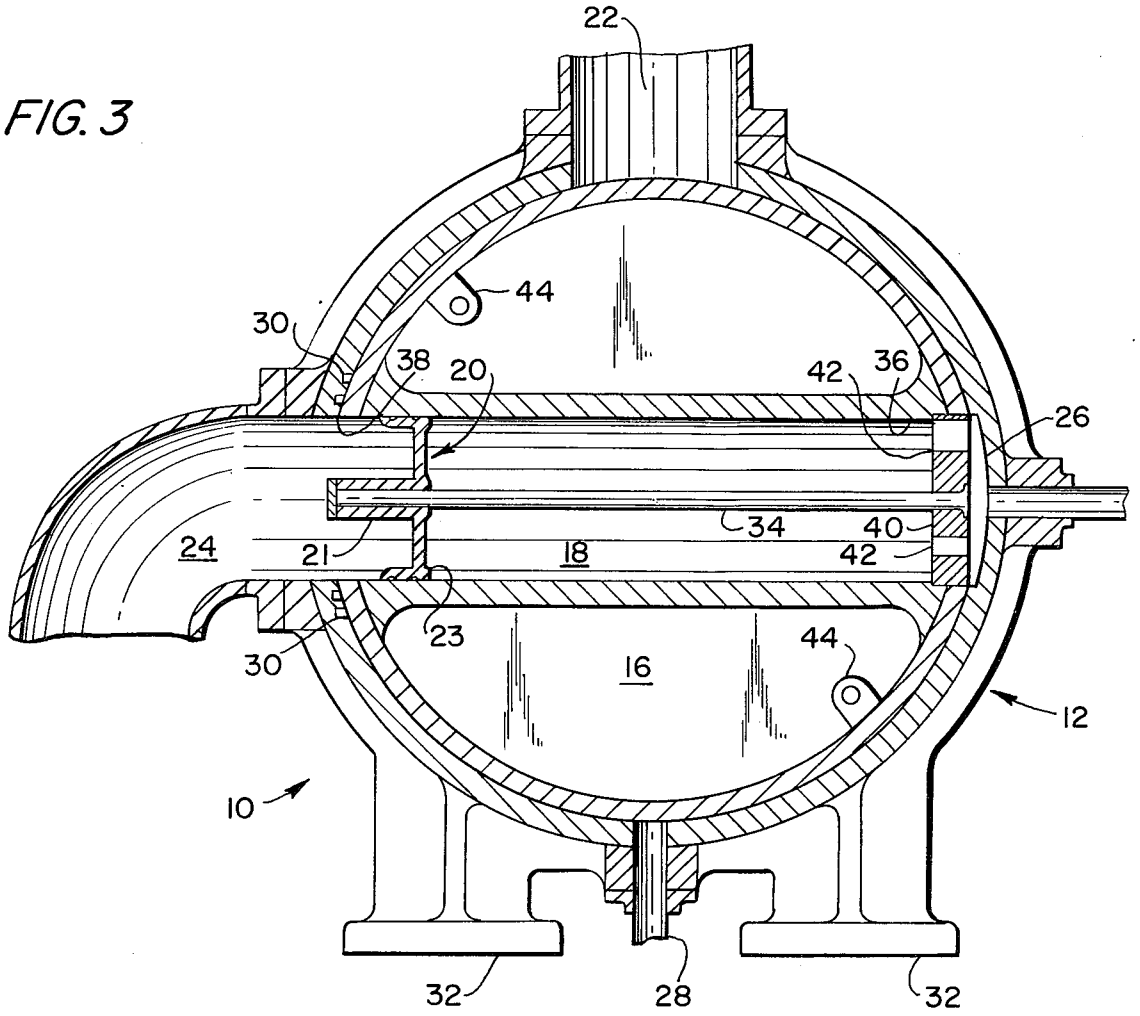
FIG. 3 is a cross-sectional view illustrating the discharge mode of the coal feed lock of FIG. 1.

Referring to FIG. 1, there is depicted the preferred embodiment of coal feed lock 10. Coal feed lock 10 includes a housing 12 having a generally cylindrical shape, as depicted in FIGS. 1 and 2 in composite. Housing 12 has a plurality of ports. These include a coal charging port 22 and a coal discharging port 24.

Housing 12 also includes a high pressure water intake port 26 and a water discharge port 28. Intake port 26 extends through the cylindrical wall of housing 12 at a location which is diametrically opposite coal discharge port 24. High pressure water intake port 26 is attachable to a source of high pressure water (not shown) that is generally maintained at a pressure of about 10psi above the gas pressure in the gasifier.

Water discharge port 28 extends through the cylindrical wall of housing 12 and is diametrically opposite coal charging port 22. Port 28 is adapted to be connected to a water sump or alternatively to a vacuum source in combination with a water sump.

Housing 12 includes a plurality of shallow grooves 30 that surround coal discharging port 24. These shallow grooves can form concentric circles (FIG. 1) about discharging port 24 or alternatively can extend radially from discharging port 24. Further, a combination of concentric and radial grooves can be used. These grooves are connectable to the high pressure water source described hereinabove.

Further, housing 12 is provided with a plurality of support legs 32. As depicted in FIG. 1, support legs 32 extend downwardly from housing 12 in the vicinity of water discharge port 28. However, depending on the geometry of the gasifier and coal storage bins, support legs can be positioned at various locations on housing 12.

Housing 12 can be formed of cast metal. Alternatively, housing 12 can be formed of metal plates that are welded or bolted together. Further, other techniques used to design and make pressure vessels, such as various metal or fiber spinning techniques, can be employed.

Rotor member 16 is rotatably mounted in housing 12. Member 16 is generally circular in cross section and includes a bore 18 therethrough. As depicted in FIG. 2, rotor member 16 can be I-shaped in diametrical cross-section with bore 18 formed along a diameter of member 16. This I-shape construction reduces the overall weight of member 16, making member 16 easier to rotate. Alternatively, rotor member 16 can have a generally right circular cylindrical shape with bore 18 therethrough. It is noted that generally the same construction techniques employed in constructing housing 12 are employed to fabricate rotatable member 16.

Located inside bore 18 is a shaft 34 that extends the entire length thereof. As depicted in FIG. 1, shaft 34 is dependent from a plate 40 placed at end 36 of bore 18. Plate 40 has apertures 42. A piston 20 is slidably mounted on shaft 34 so that piston 20 can slide from end 36 to end 38 of bore 18. Piston 20 preferably comprises a disc-like construction including a central hub 21 which rides on shaft 34 and an outer annular wall engaging flange 23.

Further, rotor member 16 has a plurality of drive pins 44 extending therefrom. A drive motor (not shown) for rotating member 16 engages member 16 by means of drive pins 44.

The operation of coal feed lock 10 in combination with a source of coal, a source of high pressure water and a high pressure gas producer or gasifier is as follows. Rotor member 16 is rotated until end 38 of bore 18 is in coaxial alignment with coal charging port 22. A measured amount of coal from the supply of coal is allowed to pass through coal charging port 22 into bore 18. The coal fills bore 18 and pushes piston 20 to a position adjacent the opposite end 36 of bore 18. When bore 18 has been filled with coal, rotor member 16 is rotated until end 38 of bore 18 moves into coaxial alignment with coal discharging port 24 and end 36 of bore 18 moves into fluid communication with high pressure water port 26. As has been previously noted, the source of high pressure water is preferably pressurized to at least 10 psi above the gas pressure in the gasifier. Thus, water flows through apertures 42 in disc 40, forcing piston 20 toward end 38 (FIG. 3) and the coal in bore 18 through coal discharging port 24 into the gasifier. Piston 20 stops adjacent end 38 of bore 18.

Next, rotor member 18 is rotated back into coaxial alignment with coal charging port 22. The minimal amount of high pressure gas trapped in bore 18 is released to the atmosphere. It can be appreciated, however, that a small amount of gas trapped in bore 18 is desirable. This small amount of high pressure gas expands to a volume equal to that of the incoming coal when the gas escapes through coal charging port 22. This expansion purges air from the coal so that little or no oxygen is introduced into the high pressure gasifier.

As end 38 of bore 18 registers with coal charging port 22, end 36 of bore 18 comes into fluid communication with water discharge or suction port 28, which drains water from bore 18.

It should be noted that high pressure water port 26 performs an additional function of statically balancing rotor member 16 in housing 12. The pressure exerted on rotor member 16 counteracts and approximately balances the pressure exerted on member 16 through coal discharging port 24 from the gasifier. This balancing prevents excessive wear of member 16.

The water behind piston 20 prevents high pressure gas from leaking between piston 20 and bore 18. It is also noted that since the aforementioned shallow grooves 30 that surround coal discharging port 24 are also connected to the source of high pressure water, any leakage between housing 12 and rotor member 16 will be water and not gas. It is possible that some small amounts of water can be forced into the gasifier, but this would not detrimentally affect the operation of the gasifier. On the other hand, the escape of gas to the atmosphere reduces the operational efficiency of the gasifier.

It is comtemplated that four coal feed locks 10 can be driven by the same variable speed motor. The drive linkage can be arranged so that feed locks 10 can cycle in sequence. Thus, the various flow of materials such as the coal and the high pressure water would virtually be continuous.

Although the present invention has been described relative to the exemplary embodiment thereof, it will be understood by those skilled in the art that variations and modifications can be effected in these embodiments without departing from the scope and spirit of the invention.

I claim:

1. A coal feed lock for dispensing coal to a high pressure gas producer, said coal feed lock comprising:

a housing including a coal discharging port and a high pressure water port at opposed locations thereon, and a coal charging port at a location spaced from said opposed locations;

a rotor member rotatably mounted within said housing and including a diametral bore therein;

a piston mounted within said bore for movement between a charging position and an actuated, discharging portion;

and means for rotating said rotor member between a first, charging position wherein said bore in said rotor member is aligned with said charging port so as to permit charging of the bore of said rotor member and a second, discharging position wherein said rotor member is aligned between said delivery port and said high pressure water port so that said piston is moved to the actuated position thereof by high pressure water from said high pressure water port to discharge the contents of said bore.

2. A coal feed lock in accordance with claim 1 wherein said housing further comprises a water discharging port located diametrically opposite said coal charging port.

3. A coal feed lock in accordance with claim 1 wherein said housing includes shallow grooving surrounding said discharging port for providing a high pressure water seal around said discharging port.

4. A coal feed lock in accordance with claim 1 further comprising a shaft mounted longitudinally in said bore, said piston slidably mounted on said shaft.

* * * * *